US005808243A

United States Patent [19]

McCormick et al.

[11] Patent Number: 5,808,243

[45] Date of Patent: Sep. 15, 1998

[54] MULTISTAGE TURBULENCE SHIELD FOR MICROPHONES

[75] Inventors: Duane C. McCormick, Colchester; William P. Patrick, Glastonbury, both of Conn.

[73] Assignee: Carrier Corporation, Syracuse, N.Y.

[21] Appl. No.: 699,674

[22] Filed: Aug. 30, 1996

[51] Int. Cl.[6] ..... G10K 11/00

[52] U.S. Cl. ..... 181/0.5; 381/88; 381/91; 381/158; 381/71; 367/901; 181/198

[58] Field of Search ..... 381/87, 88, 91, 381/158, 154, 71; 367/140, 901; 181/0.5, 198

[56] References Cited

U.S. PATENT DOCUMENTS

| | | | |
|---|---|---|---|
| 3,550,720 | 12/1970 | Ballard . | |
| 4,570,746 | 2/1986 | Das et al. | 181/242 |
| 4,903,249 | 2/1990 | Hoops et al. | 367/140 |
| 4,966,252 | 10/1990 | Drever | 181/158 |
| 5,477,506 | 12/1995 | Allen | 367/140 |
| 5,477,564 | 12/1995 | Tichy | 2/423 |

OTHER PUBLICATIONS

*Theoretical and Experimental Investigations of Microphone Probes for Sound Measurements in Turbulent Flow* By W. Neise, from the Journal of Sound and Vibration (1975) 39(3), 371–400.

*Low–Noise Windscreen Design and Performance* By Christopher W. Menge and Gonzalo Sanchez, from the "Noise–Con 94", Ft. Lauderdale, Florida, 1994 May 1–4, pp. 787–792.

*Microphone Windscreens* By John K. Hillard, from "Project Notes/Engineering Briefs", B. & K. Tech. Rev. (1969) pp. 426–427.

*Experimental Determination of the Effectiveness of Microphone Wind Screens* By John C. Bleazey, from the "Journal of the Audio Engineering Society", Jan. 1961, vol. 6, No., pp. 48–54.

*Primary Examiner*—J. Woodrow Eldred

[57] ABSTRACT

An acoustic sensing means such as a microphone or a thin-film sensor is located in a flowing medium. To prevent the sensing of flow generated noise, the sensing means is separated from the flowing medium by at least three stages of shielding. In a preferred embodiment, the sensing means is located within a foam shield which is located in a frame covered by a fabric shield and which is, in turn, located in a second frame covered by a second fabric shield. A spandex fabric is suitable for use in the present invention.

17 Claims, 9 Drawing Sheets

MULTISTAGE TURBULENCE SHIELD FOR MICROPHONES

TECHNICAL FIELD

This invention relates to sensors, such as microphones, used to detect propagating acoustic signals in turbulent flows and more particularly to the use of turbulence suppression shields to reduce the turbulence-induced noise, or "flow noise", on such sensors and to thereby increase the signal-to-noise ratio of the sensing system.

BACKGROUND OF THE INVENTION

It is known in the art of acoustic sensing in duct active noise control (ANC) systems that the rejection of pressure fluctuations due to turbulence on the input microphone(s) of the system is critical to its ability to cancel noise. This so-called "flow noise" reduces the coherence between the sense and error microphones and the level of coherence is directly related to the achievable level of noise cancellation. For example, in a feedforward ANC system, a sense-error microphone coherence level of 0.99 is required to achieve a 20 dB cancellation level and a coherence value of 0.9 reduces the cancellation level to 10 dB. For the collocated feedback approach (so-called "TCM", for tight coupled monopole) the flow noise level on the input microphone limits the performance of the system because it represents the lowest sound level which can be achieved by active cancellation if the system worked perfectly. In addition, high-amplitude low-frequency flow fluctuations sensed by the microphone cause destructive high amplitude speaker motions and system instabilities. If sufficient rejection of turbulence is not possible with a given wind screen or shield, the following four options can be considered to increase the attenuation capability of the ANC system: (1) move the ANC system downstream to a more quiescent flow region, (2) electronically filter the flow noise from the signal of the sense microphone before it is input into the controller, (3) use an array of sense microphones with appropriate signal conditioning to electronically separate the flow-induced noise from the propagating noise in the duct, and (4) use a turbulence suppression shield around the sensing microphone to selectively reduce the strength of the turbulence energy at the microphone face relative to the strength of the propagating acoustical noise signal in the duct.

For Option (1) to be effective the ANC system typically must be moved to a location downstream which is several duct heights from the fan noise source. Thus the system becomes quite long.

Option (2) can only be used when the frequency of the flow noise is outside of the performance band of the ANC system. For typical HVAC systems flow noise and acoustic noise tend to be in the same frequency band and this technique is not feasible. However, even when the flow noise frequency is outside of the desired performance band of the ANC system, time delays inherent in filtering would cause the system length to be increased (i.e., the sense microphone to control speaker distance) for adaptive feedforward systems and would reduce the performance bandwidth for feedback systems by introducing additional phase delay into the feedback loop. However, due to time delays inherent in filtering, this approach will also lengthen the overall adaptive feedforward system (increases the sense microphone to speaker distance). Even for the case where the high flow-noise levels are below the audible range (at low frequency where the performance of most flow noise shielding techniques rapidly drop off), the high amplitude flow noise can lead to destructive speaker motion, even though there is no audible noise addition to the duct .

For Option (3) to be effective at low frequency, the microphone array, in addition to being costly, must be quite lengthy, i.e. several duct heights, thus making the ANC system unacceptably long.

Option (4), the use of a turbulence suppression shield around the sense microphone, is the desired option and a unique, high performance shielding concept is the subject of this invention.

One of the most widely used approaches to reject flow noise in ducts for both basic sound measurements of fans and feedforward ANC systems is the Friedrich tube. This device consists of a hollow tube with a lengthwise slit mounted in front of a microphone and is pointed in the direction of the flow and propagating noise. Due to the phase velocity differences between the turbulent disturbances (nominally convecting at the speed of the flow in the duct, denoted by M, the Mach number) and the corresponding acoustic disturbances that the turbulence creates inside the tube (propagating at the speed of sound, c), the flow noise is "averaged-out" at the microphone, which is typically located at the downstream end of the probe. In HVAC systems when $M<<1$ the acoustic disturbances propagate at nearly the same speed outside ($c(1+M)$) and inside (c) the tube. Thus, the propagating duct acoustics are well sensed by the microphone. Digisonix Corporation sells a version of the Friedrich tube which has a porous wall (instead of a slit) to allow communication with outside disturbances. This version is the subject matter of U.S. Pat. No. 4,903,249. The disadvantage of the Friedrich/Digisonix tube is that long tubes are required to achieve flow noise rejection at low frequencies. For example, to attenuate the flow noise by 10 dB at frequencies above 10 Hz in a flow having 25% turbulence intensity requires a 48-in long probe. Moreover, no attenuation is achieved below 10 Hz which is critically needed to avoid large-amplitude destructive speaker motions for TCM applications. According to theory, as described by W. Neise in "*Theoretical and Experimental Investigations of Microphone Probes for Sound Measurements in Turbulent Flaw*", a doubling of this length will improve rejection by 3 dB. Hence, a Friedrich tube approximately 32 feet long would be needed to obtain 10 dB of flow noise rejection at 10 Hz.

A commonly used flow noise shield used on vocal microphones (e.g. microphones used for PA systems, TV, radio, etc.), is an open-cell foam shield which is typically spherical. However, an elliptical embodiment of this concept (B&K Model No. UA 0781) is used in applications when there is a predominant mean flow direction (e.g. in a duct). The flow noise rejection mechanism is to move the turbulent fluctuations away from the microphone to the outer regions of the foam shield where they are damped significantly by the foam. Due to the relatively small velocity fluctuations associated with the acoustics, the acoustic noise propagates nearly unattenuated through the foam because acoustic attenuation is proportional to velocity, whereas, turbulent flow attenuation is proportional to velocity$^2$. Though the turbulent fluctuations generate acoustic disturbances at the outer region of the foam which propagate to the microphone, due to the quadrapole acoustic source nature of turbulence, their radiation efficiency is low and hence contributes a relatively smaller amount to the microphone signal than the propagating acoustics. As will be shown below, a 3.5" (minor diameter) elliptical foam wind shield rejects flow noise slightly better than a Friedrich tube at frequencies above 100 Hz. However, below 10 Hz the flow noise is increased due to the "self-noise" generated by bluff-body shedding from the shield.

A third approach to shield the flow noise, which is used for outdoor measurements, such as airports, as described by J. K. Hilliard in *"Microphone Windscreens"* and National Park aircraft event surveys, as described by C. W. Menge and G. Sanchez in *"Low-Noise Windscreen Design and Performance"*, consists of a microphone inside a spherical cloth shield. Like the open-cell foam shield, these shields reject flow noise by moving the turbulent fluctuations away from the microphone element. It is known from J. C. Bleazey in *"Experimental Determination of the Effectiveness of Microphone Wind Screens"* that the flow noise attenuation is directly related to the sphere radius, which is consistent with the above hypothesis. It has also been demonstrated by Menge and Sanchez that a multistage cloth shield is better than a single-stage shield. Though not explained in the literature, we believe this is due to the inner stage reducing the magnitude of the inevitable internal recirculation flow that is exposed to the microphone element.

SUMMARY OF THE INVENTION

The novelty of this invention is a multistage cloth shield designed for a predominant flow direction. The shield consists of two stages of Lycra fabric stretched over a wire frame. The final, inner or third stage is a B&K open-cell foam wind shield. The flow noise reduction shows the remarkable result of 10–20 dB of flow noise rejection over the entire frequency band. To confirm these measurements, the coherence between a shielded microphone near the fan exit of a 20-ton VPAC (Vertical Packaged Air Conditioner.) where the turbulence intensity was 25% and a shielded microphone 9 feet downstream were obtained for a 48 inch long Digisonix tube, an ellipsoidal foam screen, and the new multistage Lycra shield. This measurement, as stated before, determines the maximum attenuation of a feedforward system. The new shield demonstrates superior performance over the entire frequency band except at 40 Hz where the 48 inch tube gives the same level of performance. Other advantages of the new shield are its observed flat frequency response and omnidirectional response which makes it better suited for collocated feedback duct ANC. The Friedrich tube, due to its rigid terminations, contains internal modal structure which gives rise to phase margin instabilities and is predominantly sensitive to the acoustic signal propagating down the duct and, hence, rejects the speaker "antinoise", forming an incorrect error signal.

It is an object to this invention to shield a microphone from flow noise. It is another object of this invention to permit placement of a sensing microphone in turbulent flow while avoiding sensing flow noise. These objects, and others as will become apparent hereinafter, are accomplished by the present invention.

Basically, a microphone is located such that it is exposed to noise from the noise source to be sensed but is shielded from flow generated noise due to a flowing medium acting on the microphone. This is achieved by locating the microphone in three nested sound shields located in and/or exposed to the flowing medium. The sensing portion of the microphone is located in a foam cover defining a first sound shield and located within an inner frame. The inner frame is overlain by a fabric defining a second sound shield and is located within an outer frame. The outer frame is overlain by a fabric defining a third sound shield and an aerodynamic surface exposed to the flowing medium.

BRIEF DESCRIPTION OF DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
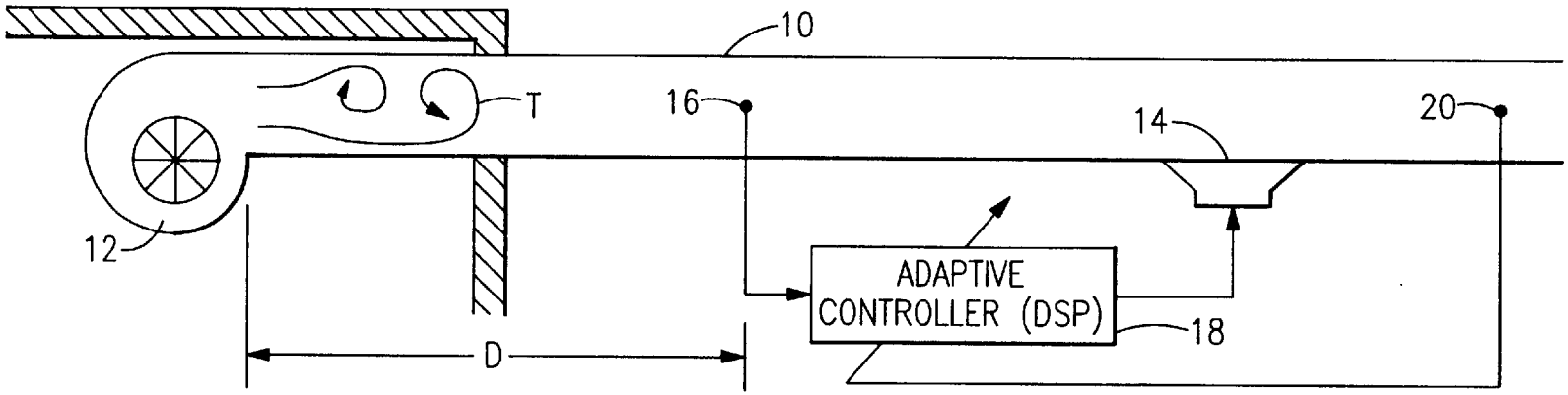
FIG. 1 is a schematic representation showing an ANC system for ducted systems employing an adaptive feedforward approach.
Figure 2:
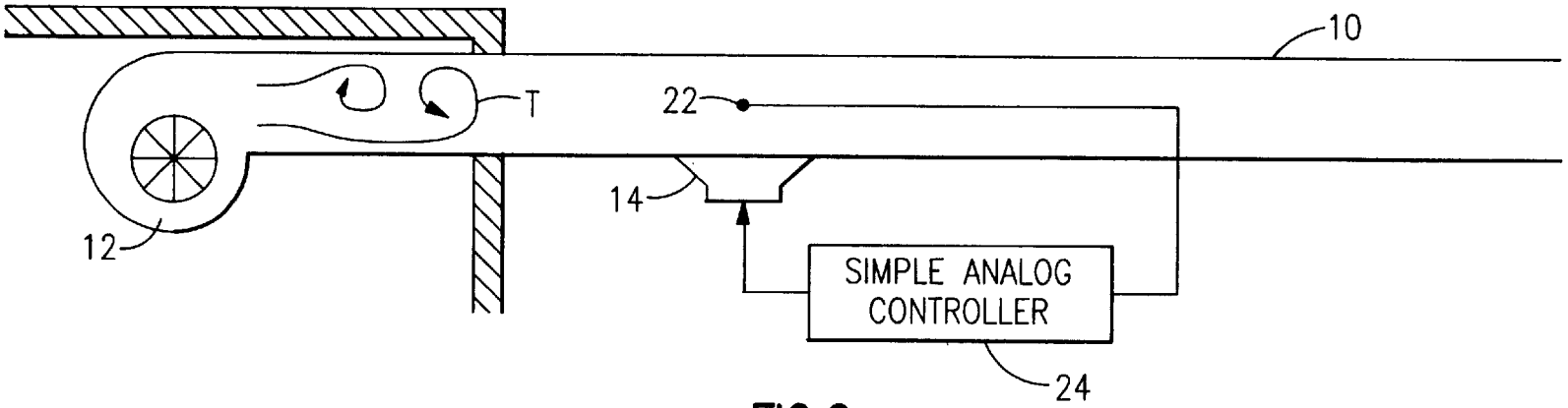
FIG. 2 is a schematic representation showing an ANC system for ducted systems employing an collocated feedback approach.

In FIGS. 1 and 2, the numeral 10 generally designates a duct such as that used in the distribution of conditioned air.

The upstream fan 12 produces noise, primarily due to aerodynamically-driven noise mechanisms, such as trailing-edge noise, which propagates down the duct. An effective means to control the lowest frequencies of this noise, developed in recent years, is active noise control, whereby a control speaker 14 is used to create an opposite-sign pressure disturbance in order to "cancel" the undesired noise. This cancellation is effected either by reflecting the sound back toward the source (ie. a purely reactive system), absorbing the sound energy by the control speaker 14, or by a combination of both such mechanisms. FIGS. 1 and 2 show the two principal means to achieve duct ANC (active noise control), adaptive feedforward in FIG. 1 and collocated feedback in FIG. 2. For the adaptive feedforward approach of FIG. 1, a sense microphone 16 detects the propagating noise and feeds this signal forward through an adaptive DSP (digital signal processor) controller 18 which compensates the signal for time delay, attenuation of the sound amplitude, duct modes, speaker dynamics, etc. and supplies a signal to the control speaker 14 which cancels the noise. A downstream error microphone 20 detects the residual noise. The signal from the downstream microphone 20 is used to adapt the coefficients of the DSP 18 in such a manner to minimize this residual noise signal at the error microphone 20. The collocated feedback approach of FIG. 2 employs microphone 22 which measures the summed fan noise and speaker noise, an analog controller 24, and a control speaker 14. The signal from microphone 22 is input to the analog controller 24 which continuously adjusts the ouminimize the sigspeaker 14 to minimize the signal detected by microphone 22. In general, the adaptive feedforward approach of FIG. 1 allows higher performance than the feedback approach of FIG. 2, but at the expense of system length and cost.

For either duct ANC system, it is advantageous to locate the system as close as possible to the discharge of the fan, ie. minimize length D, the distance between the discharge of fan 12 and the nearest microphone 16 or 22, in order to minimize space requirements for the system. However, the turbulence T in the nearfield of the fan discharge is extremely high and prevents fully employing this strategy. Such turbulence fluctuations may exceed 50% of the average flow speed in the duct 10. The pressure oscillations caused by the turbulent structures impinging on the microphones 16 and 22 generate a "flow noise" signal that adds with the acoustic pressure oscillations. The flow noise will limit the amount of noise cancellation which can be achieved by the ANC system. For example, if the flow noise is lower than the acoustic noise, the attenuation will be limited to that fraction of the acoustical signal which can be detected above the flow noise floor. Moreover, if the flow noise is higher than the acoustic noise, then the ANC system will broadcast the flow noise through the control speaker, thereby being a noise generator rather than a noise attenuator. To increase the attenuation capability of the ANC system four options can be considered: (1) move the ANC system downstream to a more quiescent flow region, (2) electronically filter the flow noise from the signal from microphone 14 before it is input into the controller 18, or from microphone 22 before it is input into controller 24, (3) use an array of sense microphones with appropriate signal conditioning to electronically separate the flow-induced noise from the propagating noise in the duct 10, and (4) use a turbulence suppression shield around microphones 16 and 22 to selectively reduce the strength of the turbulence energy at the microphone face relative to the strength of the propagating acoustical noise signal in the duct 10. Option (4), the use of a turbulence suppression shield around the sense microphone, is the desired option and a unique, high performance shielding concept is the subject of this invention.

Figure 3:
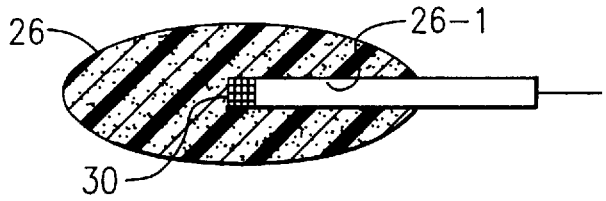
FIG.3 Prior Art
FIGS. 3 and 4 show sectional views of PRIOR ART flow noise suppression shields.
Figure 4:
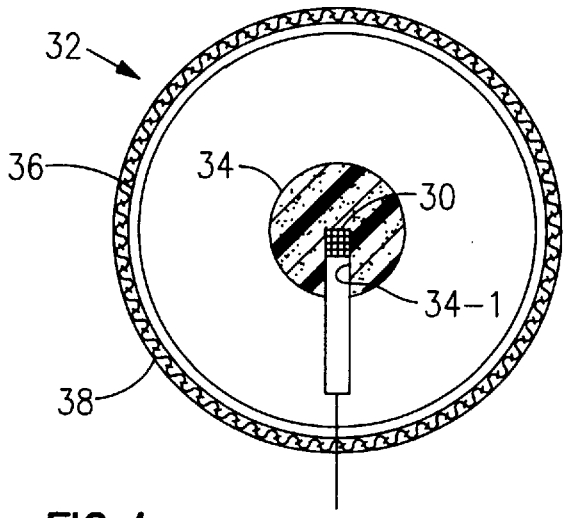
FIG.4 Prior Art

FIG. 3 shows a PRIOR ART ellipsoidal, open-cell foam windscreen 26 which has a bore 26-1 which receives the sensor portion of microphone 30. FIG. 4 shows a PRIOR ART outdoor multistage Lycra wind screen 32. Windscreen 32 includes a spherical open-cell foam member 34 having a bore 34-1 which receives microphone 30. Foam member 34 is supported within spherical frame 36 which is covered by a Lycra fabric 38.

Figure 5:
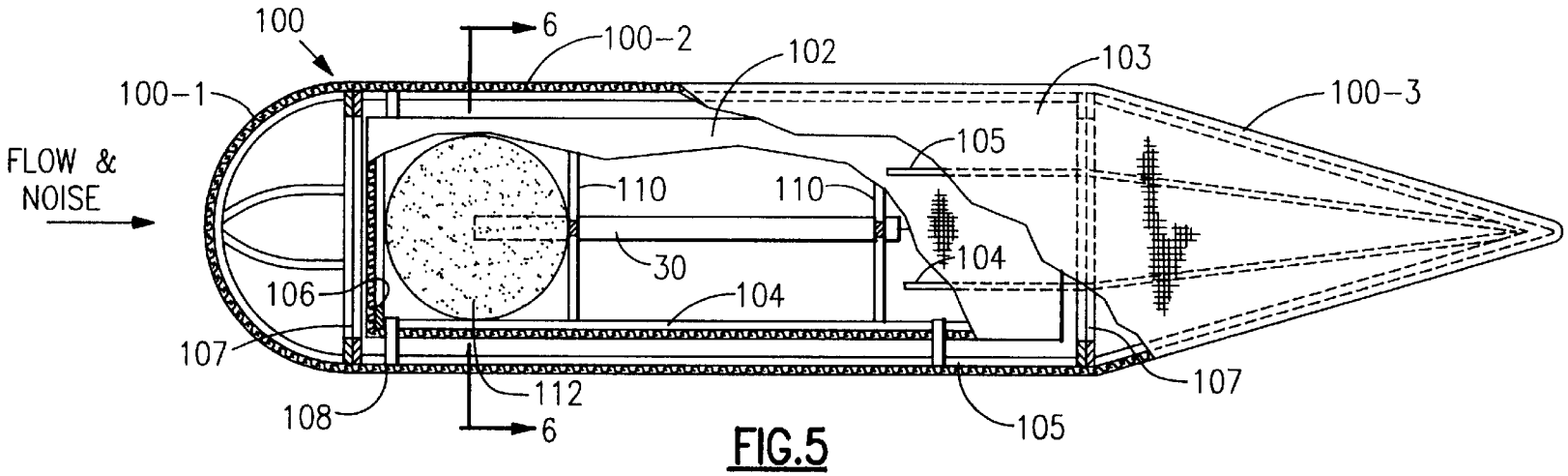
FIG. 5 is a partially cutaway view of a shielded microphone of the present invention.
Figure 6:
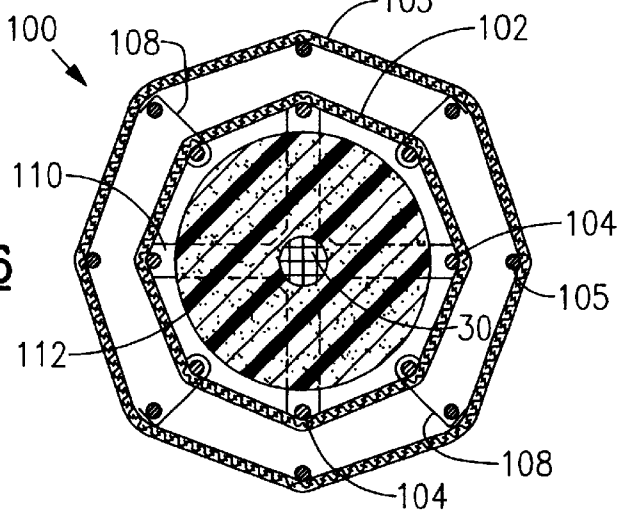
FIG. 6 is a sectional view taken at line 6—6 of FIG. 5.

FIGS. 5 and 6 illustrate a preferred embodiment of the microphone shield 100. In this embodiment, a suitable configuration is, nominally, two feet long with head portion 100-1 being a five-inch hemisphere, body portion 100-2 being a cylinder, and tail portion 100-3 being a cone. The shield 100 has an aerodynamic shape which is one with little or no flow separation or, in which any flow separation is sufficiently removed from the proximity of the microphone so that the microphone does not sense any self noise caused by the shedding. Another feature of aerodynamically shaped bodies is addition to low self noise is its inherent low parasitic drag which is the sum of all drag components from all non-lifting parts of a body, usually defined as total drag minus induced drag. The shield 100 consists of two stages of stretchable, Lycra fabric, and one stage of open-cell foam surrounding the sensing element of the microphone 30. The inner Lycra stage 102 is supported by a wire frame structure consisting of streamwise rods 104 welded to circular hoops 106. Similarly the outer Lycra stage 103 is supported by a wire frame structure spaced from inner Lycra stage 102 and consisting of streamwise rods 105 welded to circular hoops 107. The inner and outer Lycra stages 102 and 103, respectively, are positioned using support clips 108. As is best shown in FIG. 6, clips 108 pass through Lycra stage 102. For strength, to control the slit size, and to prevent tearing, the openings in Lycra stage 102 which receive clips 108 may be in the nature of a buttonhole reinforced with a buttonhole stitch. The microphone 30 is supported in the center of the inner wire frame formed by members 104 and 106 by supports 110 which have at least two radially extending portions coacting with the inner wire frame. Open-cell foam shield 112 is fitted snugly over the sensing element of microphone 30.

Figure 7:
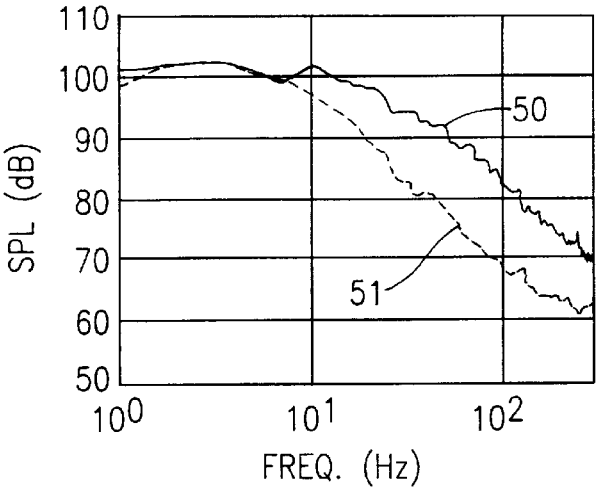
FIG.7 Prior Art
FIG. 7 is a graph of flow noise (sound pressure level, SPL) versus frequency for an unshielded microphone and for a PRIOR ART 48 inch Friedrich tube.
Figure 8:
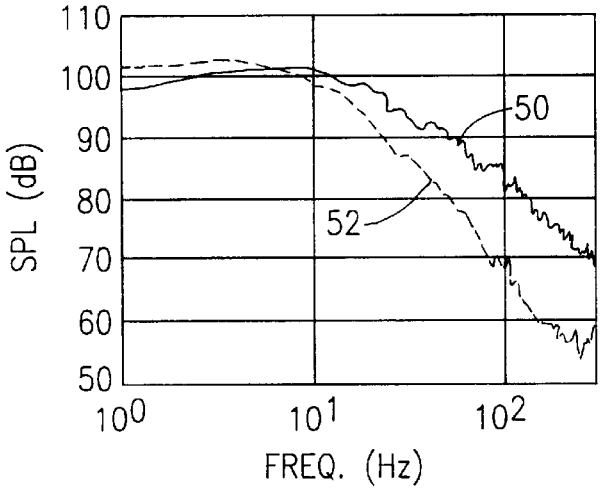
FIG.8 Prior Art
FIG. 8 is a graph of flow noise (SPL) versus frequency for an unshielded microphone and the PRIOR ART shield of FIG. 3.
Figure 9:
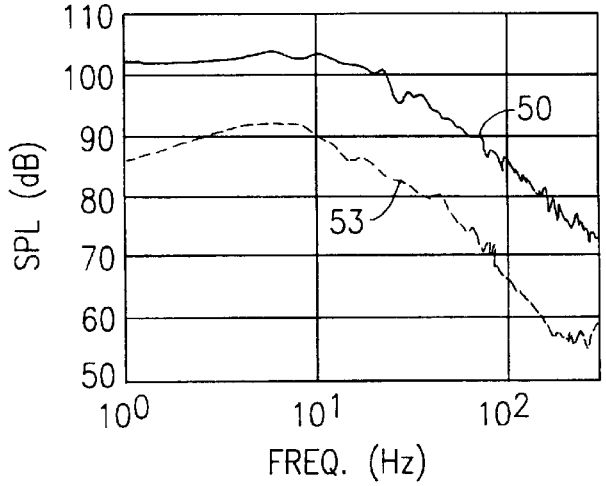
FIG. 9 is a graph of flow noise (SPL) versus frequency for an unshielded microphone and the preferred embodiment of FIG. 5.
Figure 10:
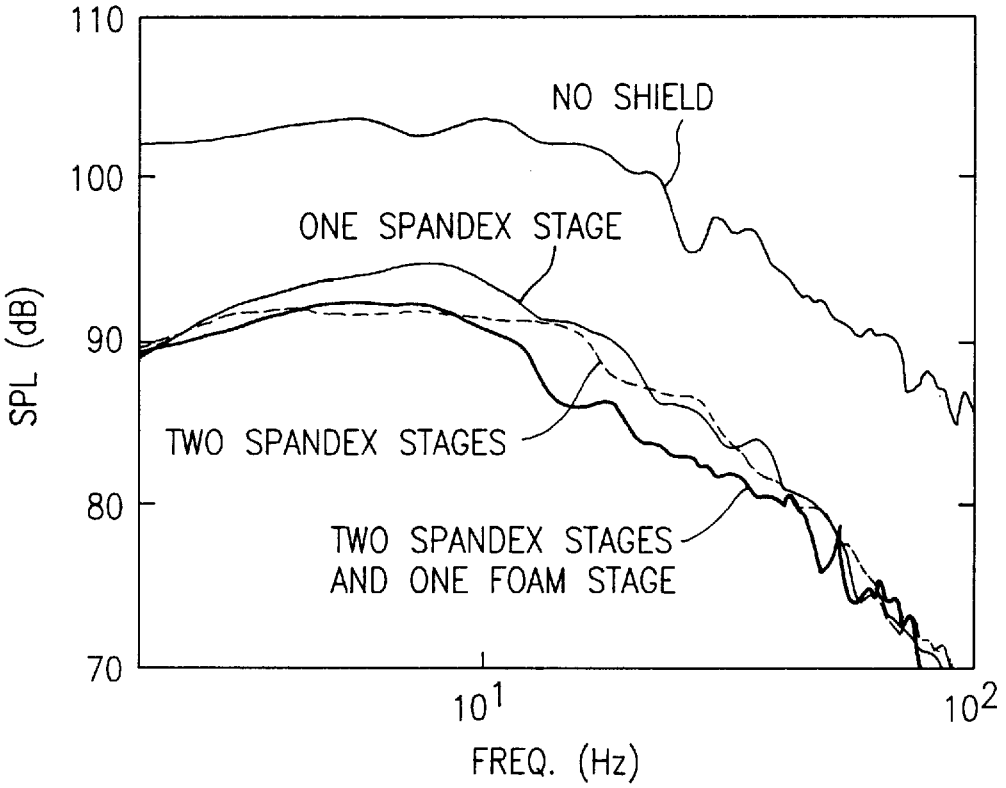
FIG. 10 is a graph of flow noise (SPL) versus frequency for no shield, one spandex stage, two spandex stages and for the preferred embodiment of FIG. 5.

The performance of the microphone shield 100 relative to two conventional shields in a flow having a 25% turbulence is shown in FIGS. 7–9. The plots show the flow-noise sound pressure level (SPL in dB rms, 20 micro-Pascals reference) experienced by the microphone versus frequency. The line 50 in the plots represents the flow noise measured by an unshielded microphone (with bullet-type nose cone to reduce self noise). The lines 51 in FIG. 7, 52 in FIG. 8, and 53 in FIG. 9, represent the flow noise measured by the microphone with three different shields, a Friedrich tube, the open-cell foam elliptical shield of FIG. 3, and the Lycra multistage shield 100 of FIG. 5, respectively. Both the Friedrich tube, which employs a porous tube instead of the standard slit tube, and the open-cell foam shields (B&K Model No. UA 0781) work well above 10 Hz, providing 10–15 dB of flow noise rejection. Below 10 Hz, there is no rejection. In fact, due to self noise generated by vortex shedding from the aft end of the shield the open-cell foam shield actually adds noise to the microphone signal at frequencies below 10 Hz. This self noise illustrates that the aerodynamic design of this shield 26 is of insufficient quality since the separated flow region has not been sufficiently suppressed and/or removed from the proximity of the microphone. In contrast, the Lycra multistage shield 100 provides over 10 dB rejection below 10 Hz and 15–20 dB above 10 Hz, hence significantly out performing the other shields across the entire frequency band. The importance of the multistage feature of the present invention is illustrated in FIG. 10 which shows that flow noise rejection is progressively improved with each additional stage. Upon examining FIG. 10, it is apparent that one and two stages of spandex are not uniformly superior, one to the other. Accordingly, there is no clear advantage to using two layers of spandex, rather than one, and there are disadvantages, in performance, for specific frequency ranges.

Figure 11:
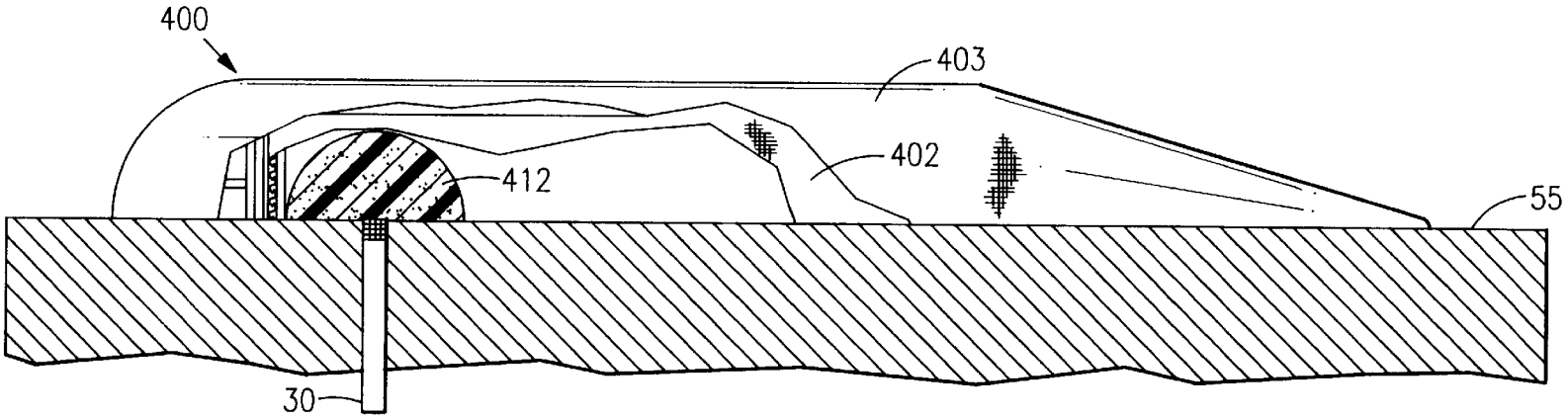
FIG. 11 is a sectional view of a wall-mounted first modified embodiment of the present invention.
Figure 12:
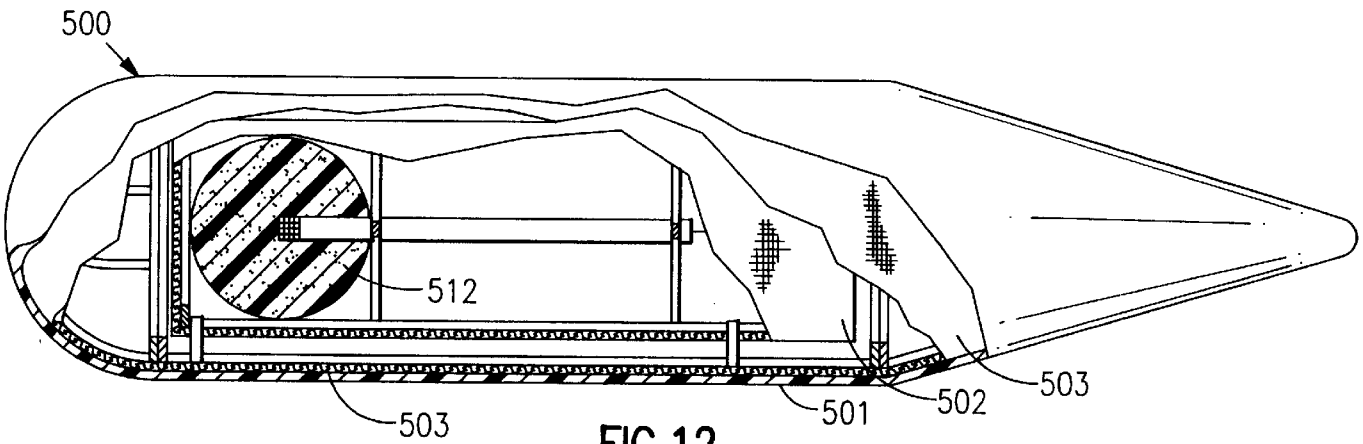
FIG. 12 is a partially cutaway view of a second modified embodiment of the present invention wherein the outer permeable layer has been covered by an impermeable membrane.

A wall-mounted version of the shield, 400, is shown in FIG. 11 and may be useful in certain applications, such as to reduce shield blockage to the flow, or when the flow noise is less near the wall, i.e. cases of high freestream turbulence. Shield 400 differs from shield 100 in being half of shield 100 with the equivalent of a cut being made along the axis. Microphone 30 is repositioned so as to be radially extending rather than axially extending. Further, microphone 30 is supported in/by the wall 55. Relative to the flowing air, microphone 30 in the FIG. 11 embodiment is separated in the same manner as the FIG. 5 embodiment, namely by the serial layers of open-cell foam 412 and two stages of Lycra fabric 402 and 403, respectively. The embodiment of FIG. 12 illustrates the shield 500 which is identical to shield 100 of FIG. 5 with the addition of an impermeable membrane 501 over outer Lycra stage 503. Impermeable membrane 501 is acoustically transparent and may be suitably made of a material such as Mylar or aluminized polyester. Membrane 501 may be attached to or spaced away from stage 503. Inner stage 502 and one cell foam 512 correspond to 102 and 112 of FIG. 5. This arrangement will improve the shield resistance to clogging by foreign matter and/or improve its flow noise rejection.

Figure 13:
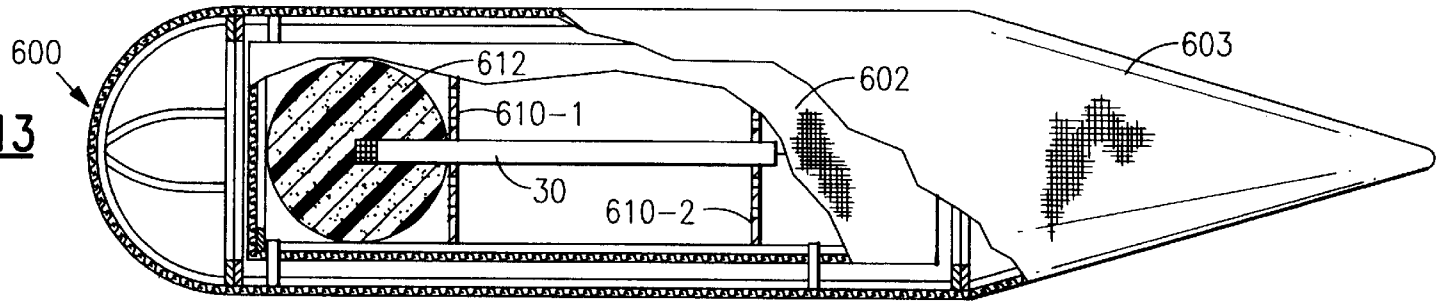
FIG. 13 is a partially cutaway view of a third modified embodiment of the present invention wherein internal permeable baffles are incorporated to reduce flow recirculation within the internal shield.
Figure 14:
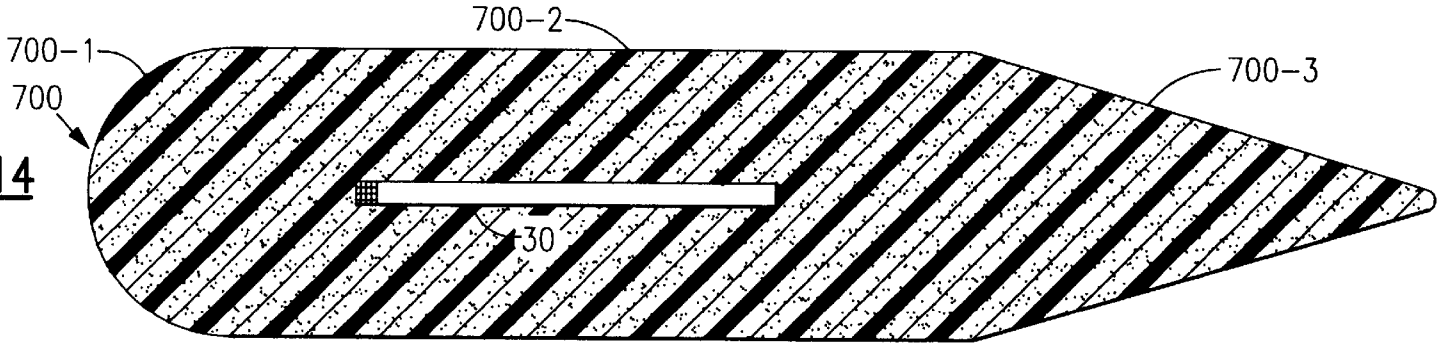
FIG. 14 is a sectional view of a fourth modified embodiment of a solid open-cell foam version of the aerodynamically shaped turbulence shield.
Figure 15:
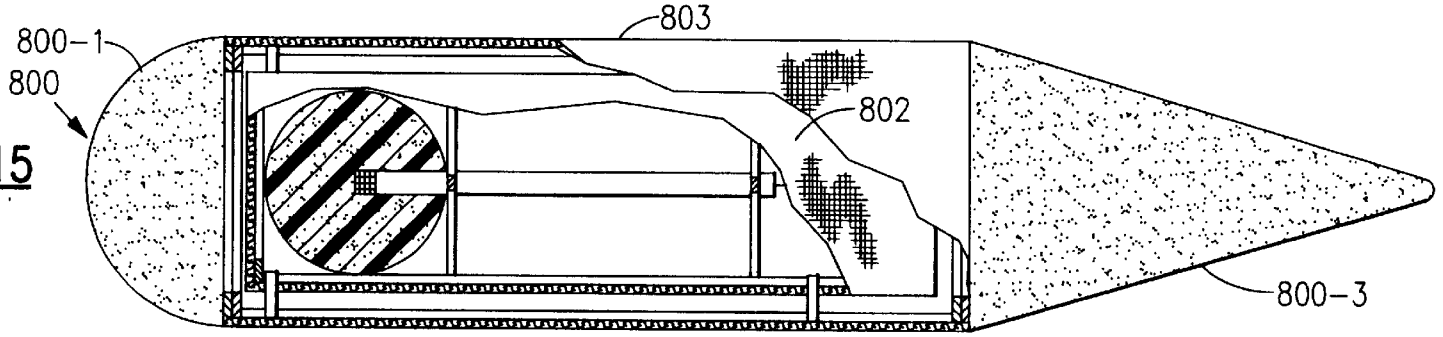
FIG. 15 is a partially cutaway view of a fifth modified embodiment of the present invention wherein the nose cone and tail cone are solid impermeable materials.
Figure 16:
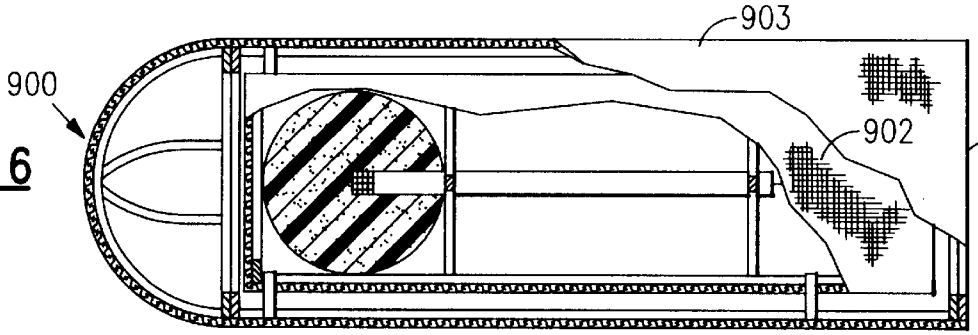
FIG. 16 is a partially cutaway view of a sixth modified embodiment of the present invention wherein the tail cone has been eliminated.
Figure 17:
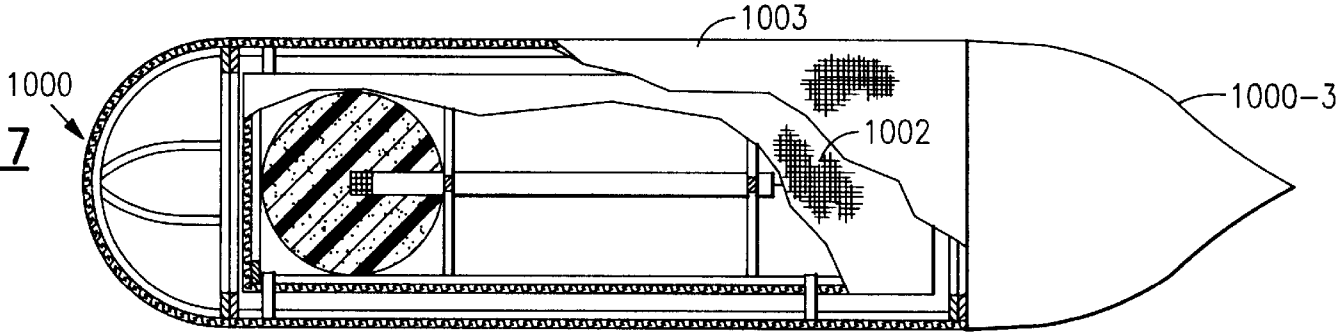
FIG. 17 is a partially cutaway view of a seventh modified embodiment of the present invention wherein the tail cone is non-conical.
Figure 18:
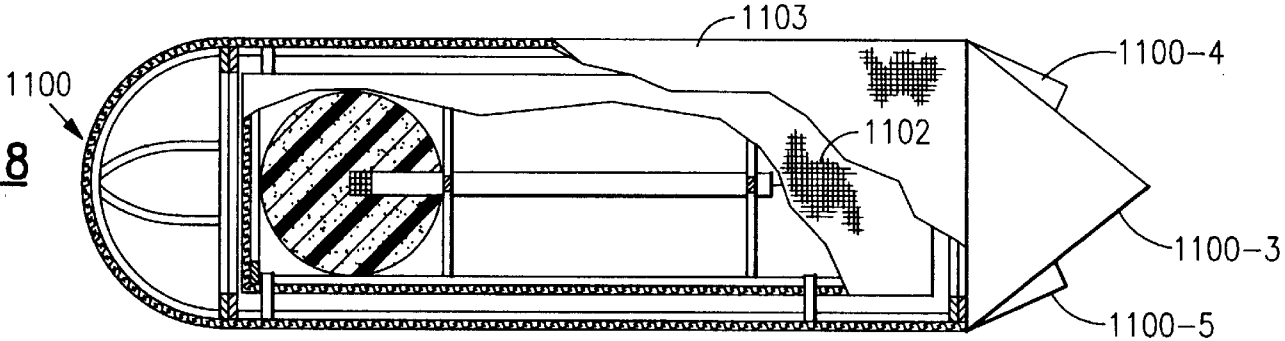
FIG. 18 is a partially cutaway view of an eighth modified embodiment of the present invention wherein the tail cone is augmented with vortex generators.

Referring now to FIG. 13, shield 100 of FIG. 5 has been modified to shield 600 by replacing supports 110 with baffles 610-1 and 610-2. Baffles 610-1 and 610-2, like supports 110, support microphone 30. The vertical baffles 610-1 and 610-2 more effectively reduce the internal flow recirculation within shield 600 which contributes to the flow noise. Stages 602 and 603 correspond to stages 102 and 103 of FIG. 5 and open-cell foam 612 corresponds to open-cell foam 112 of FIG. 5. FIG. 14 shows a shield 700 constructed entirely of open-cell foam. The key difference between shield 700 and PRIOR ART shield 26 of FIG. 3 is the aerodynamic shape designed for a single mean flow direction, i.e. the duct application, with particular attention given to the angle of the trailing edge, defined by the tail, to avoid flow separation which causes self noise. As illustrated shield 700, in the direction of flow serially includes hemispherical portion 700-1, cylindrical portion 700-2 and conical tail portion 700-3. The open-cell foam is inherently rough but while shield 700 would have a higher surface friction drag, it would have a much lower form drag under certain conditions (e.g. for low Reynolds numbers) which results in a lower profile drag (total drag minus induced drag; sum of form drag and surface friction drag) for shield 700 compared to a smooth shield. Shield 800 which is shown in FIG. 15 differs from shield 100 of FIG. 5 in replacing head portion 100-1 which is a hemispherical frame overlain by Lycra 103 with a solid, closed-cell foam hemispherical portion 800-1. Additionally, tail portion 100-3 which is a conical frame overlain by Lycra 103 has been replaced with a solid, closed-cell foam conical portion 800-3. Otherwise, shield 800 is the same as shield 100. An advantage of this embodiment is ease of manufacturing. Outer Lycra stage 803 is only an open-ended cylinder and is secured to head portion 800-1 and tail portion 800-3 by metal clips or any other suitable means. Inner Lycra shield 802 is identical to shield 102. Shields 900, 1000 and 1100 of FIGS. 15 to 17, respectively, differ from shield 100 of FIG. 5 in their trailing edge configurations. Shields 900, 1000, and 1100 have inner Lycra shields 902, 1002 and 1102, respectively, and outer Lycra shields 903, 1003 and 1103, respectively. Shield 900 eliminates tail portion 100-3 and has a truncated trailing edge 900-3. Although shield 900 lacks a tail, the flow separation is sufficiently removed from the proximity of the microphone such that the microphone does not sense any self noise caused by the shedding. Shield 1000 has a boat-tailed trailing edge 1000-3 to provide better separation control in a more compact arrangement. Outer Lycra shield 1003 does not extend over trailing edge 1000-3 which is made of a material having a solid surface, e.g. wood, plastic, plastic over a foam core, rubber, etc. Shield 1100 replaces conical tail portion 100-3 with an aggressive (short) trailing edge 1100-3 with boundary layer separation control in the form of vortex generators 1100-4 and 1100-5 which allow compact shape with no loss in the flow noise rejection performance. Outer Lycra shield 1103 does not extend over the trailing edge 1100-3 which is made of material such as that used to fabricate trailing edge 1000-3.

Figure 19:
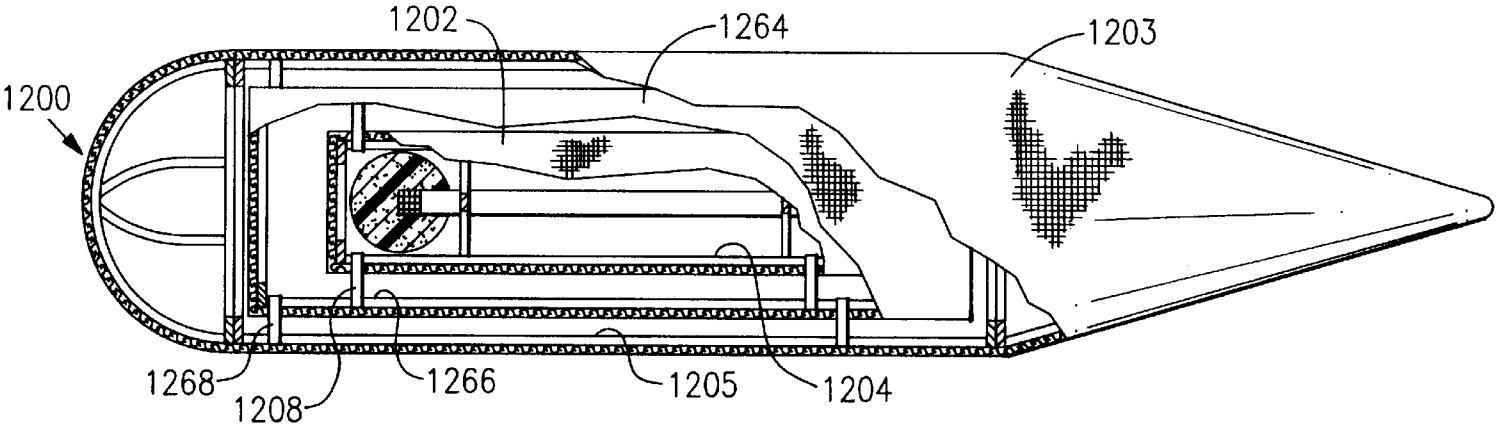
FIG. 19 is a partially cutaway view of a ninth modified embodiment of the present invention containing more than two stages of fabric shielding.
Figure 21:
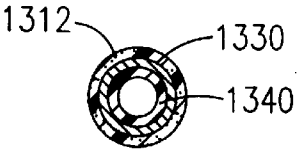
FIG. 21 is a sectional view taken along line 21—21 of FIG. 20.
Figure 20:
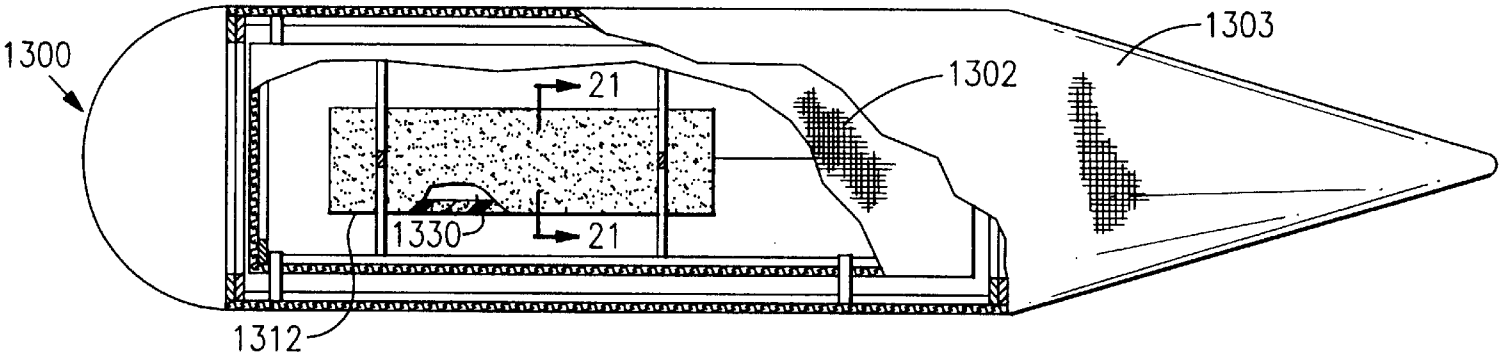
FIG. 20 is a partially cutaway view of a tenth modified embodiment of the present invention wherein the conventional microphone has been replaced by a thin-film acoustic sensor.

Referring now to FIG. 19, shield 1200 differs from shield 100 of FIG. 5 in the provisions of the third stage of Lycra located between the structure corresponding to inner Lycra stage 102 and outer Lycra stage 103 of shield 100. Inner Lycra stage 1202 corresponds to inner Lycra stage 102 but clips 1208 connect between streamwise rods 1204 of stage 1202 and streamwise rods 1266 of intermediate Lycra stage 1264. Similarly, clips 1268 connect between streamwise rods 1266 of intermediate Lycra stage 1264 and streamwise rods 1205 of outer Lycra stage 1203. This embodiment provides additional rejection of flow noise. Additional stages may be added for even further improvement. Shield 1300 of FIG. 19 differs from shield 100 of FIG. 5 in replacing microphone 30 with a thin-film acoustic sensor 1330, for example PVDF, polyvinyldifluoride, material or optical fibers, applied over a hollow core 1340 which is made of plastic, Teflon, or similar material to include spatial averaging of the turbulence to improve flow-noise rejection. Foam 1312 covers acoustic sensor 1330. Inner Lycra stage 1307 and outer Lycra stage 1303 are the same as stages 103 and 103 of FIG. 5.

Although preferred embodiments of the present invention have been illustrated and described, other changes will occur to those skilled in the art. Although the present invention has been specifically described in terms of Lycra/spandex, other materials may be used for one or more of the layers. For example, other fabrics such as nylon may be used as well as porous plastic. Also, microphones and thin film acoustic sensors are generally interchangeable, with minor changes, for the various embodiments of the present invention. Also, if necessary or desirable, more than one acoustic sensor can be located within a shield. It is therefore intended that the present invention is to be limited only by the scope of the appended claims.

What is claimed is:

1. A unidirectionally aerodynamically shaped multistage turbulence shield for an acoustic sensing means of a duct active noise canceling system comprising:

a duct defining a flow path;

acoustic sensing means located in said duct;

first shield means made of open cell foam receiving said acoustic sensing means and being located intermediate said acoustic sensing means and said flow path;

second shield means made of fabric spaced from and containing said first shield means and being located intermediate said first shield means and said flow path;

third shield means spaced from and containing second shield means and being intermediate said second shield means and said flow path whereby said turbulence shield produces little self noise and flow separation due to air flow through said flow path relative to said acoustic sensing means.

2. The shield in claim 1 wherein said second and third shield means each includes an elastic fiber material covering a frame.

3. The shield of claim 2 wherein said elastic fiber material is spandex.

4. The shield of claim 1 wherein said second shield means contains an air space surrounding said sensing means.

5. The shield of claim 4 wherein said third shield means contains an air space surrounding said second shield means.

6. The shield of claim 1 wherein said third shield means is made of fabric and contained within a fourth shield means wherein said fourth shield means is an impermeable membrane.

7. The shield of claim 1 wherein said third shield means is an impermeable membrane.

8. The shield of claim 1 wherein said acoustic sensing means is a wall-mounted microphone and said shield is adapted to be secured to a wall.

9. The shield of claim 1 further including internal permeable baffle means contained within said second shield means.

10. The shield of claim 1 further including an aerodynamically shaped nose and tail.

11. The shield of claim 10 wherein at least one of said nose and tail is permeable.

12. The shield of claim 10 wherein at least one of said nose and tail is impermeable.

13. The shield of claim 10 wherein said tail is non-conical.

14. The shield of claim 10 wherein said tail is shorter than the length needed to ensure attached flow without external means defined by vortex generators located around the periphery of said tail so as to induce flow to stay attached to said tail.

15. The shield of claim 1 wherein said acoustic sensing means is a thin-film sensor.

16. The shield of claim 1 wherein said aerodynamic shape is such that any flow separation present is sufficiently removed from said acoustic sensing means such that any self noise caused by air flow separation is not sensed by said acoustic sensing means.

17. The shield of claim 1 wherein said aerodynamic shape is such that little, if any, flow separation is produced.

* * * * *